US006729965B2

(12) United States Patent
Howard et al.

(10) Patent No.: US 6,729,965 B2
(45) Date of Patent: May 4, 2004

(54) GOLF PRACTICE DEVICE

(75) Inventors: Bill Eugene Howard, Ulysses, KS (US); James C. Hayden, Montezuma, KS (US)

(73) Assignee: Harmsway, LLC, Ulysses, KS (US)

( * ) Notice: Subject to any disclaimer, the term of this patent is extended or adjusted under 35 U.S.C. 154(b) by 0 days.

(21) Appl. No.: 10/192,045

(22) Filed: Jul. 10, 2002

(65) Prior Publication Data

US 2004/0014530 A1 Jan. 22, 2004

Related U.S. Application Data

(63) Continuation of application No. 09/757,156, filed on Jan. 9, 2001, now Pat. No. 6,497,624.

(51) Int. Cl.[7] ..... A63B 57/00
(52) U.S. Cl. ..... 473/134
(58) Field of Search ..... 473/132–137; D21/791

(56) References Cited

U.S. PATENT DOCUMENTS

| | | | | |
|---|---|---|---|---|
| 1,785,150 | A | | 12/1930 | Soubier et al. |
| 1,937,180 | A | | 11/1933 | Young |
| 2,618,483 | A | | 11/1952 | Chiodo |
| 2,789,824 | A | | 4/1957 | Willcox |
| 3,458,204 | A | | 7/1969 | Wilson |
| 4,141,558 | A | | 2/1979 | Hoffman |
| 4,817,955 | A | | 4/1989 | Hickson et al. |
| 4,995,614 | A | | 2/1991 | Tange |
| 5,071,131 | A | | 12/1991 | Turnidge et al. |
| 5,096,200 | A | | 3/1992 | Komori et al. |
| 5,259,622 | A | | 11/1993 | Irving |
| 5,282,628 | A | | 2/1994 | Komori et al. |
| 5,529,307 | A | | 6/1996 | Chang |
| 5,704,844 | A | | 1/1998 | Luther |
| 5,860,870 | A | | 1/1999 | Park |
| D424,647 | S | | 5/2000 | Hayden |
| 6,315,676 | B1 | | 11/2001 | Sandlin |
| 6,497,624 | B2 | * | 12/2002 | Howard et al. ..... 473/134 |
| 6,572,485 | B2 | * | 6/2003 | Howard et al. ..... 473/134 |

* cited by examiner

*Primary Examiner*—Steven Wong
(74) *Attorney, Agent, or Firm*—Shook, Hardy & Bacon L.L.P.

(57) ABSTRACT

A portable machine for delivering golf balls one at a time onto a tee or a surface simulating a fairway. A bin holds a quantity of practice balls and has a turntable underlying it. An opening on the turntable provides a ball pocket which receives one ball at a time and carries the ball around a circular path to a position aligned above a chute. Each ball delivered by the chute is discharged onto a fairway area or into an inclined trough, depending on how the chute is oriented. At the bottom end of the trough, a tee is raised to tee each ball up at a high or low height, depending upon the setting of a selector switch. A platform which provides a surface on which the user stands is detachable to allow the machine to be carried and stored in two separate pieces.

1 Claim, 7 Drawing Sheets

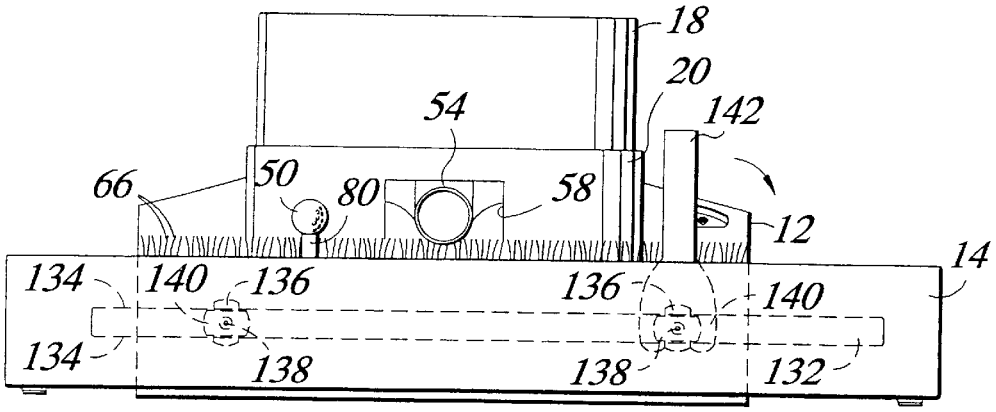
FIG. 12.
FIG. 13.
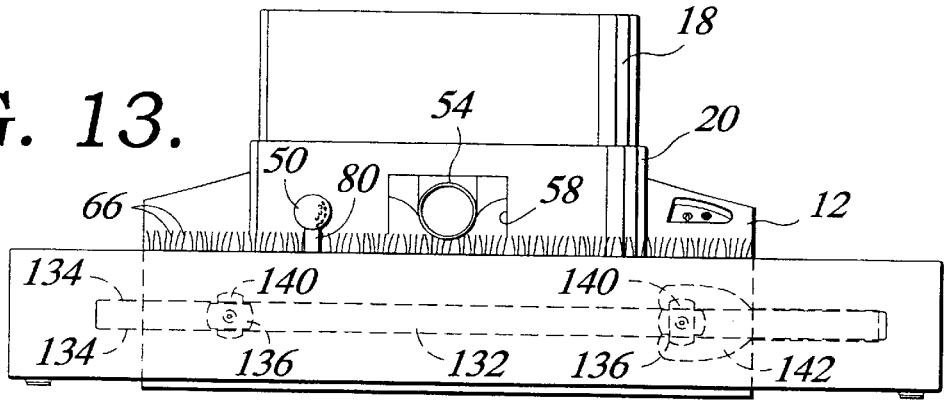
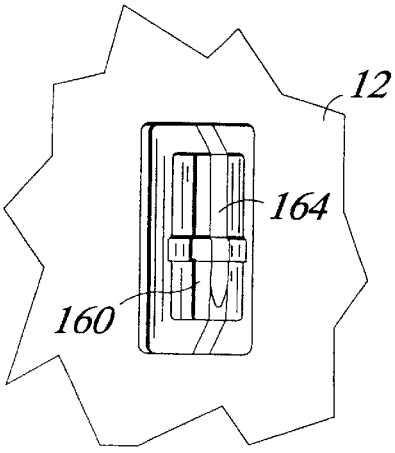
FIG. 14.
FIG. 15.
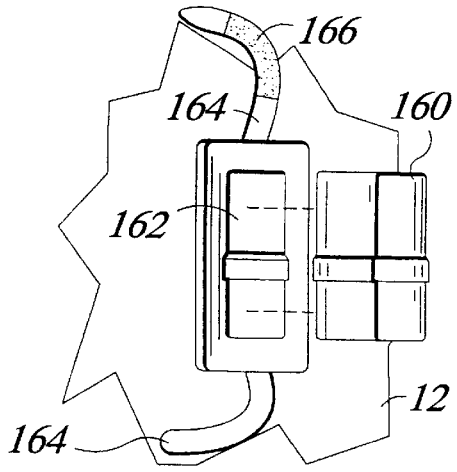

GOLF PRACTICE DEVICE

This application is a continuation of Ser. No. 09/757,156 filed Jan. 9, 2001, now U.S. Pat. No. 6,497,624.

FIELD OF THE INVENTION

This invention relates generally to golf practice equipment and more particularly to an automated device for delivering golfballs one at a time to a ball striking area from which the balls may be struck for practice.

BACKGROUND OF THE INVENTION

Driving ranges for practicing golf shots typically provide a mat having a surface which generally simulates a fairway surface. Often, a tee is provided on the mat which allows the golfer to tee balls up to practice tee shots. The balls ordinarily must be placed on the tee by hand or properly located on the mat with a golfclub head. There have been automated systems proposed for delivering balls to the striking area in order to reduce the inconvenience and time involved in manually teeing the balls. For example, U.S. Pat. No. 2,789,824 to Willcox discloses a machine that dispenses balls and tees them up automatically.

Automated golf ball dispensing equipment must handle the balls in a manner to prevent them from jamming, being misapplied to the tee, or otherwise mishandled. Such problems have been prevalent in the past due largely to the use of electric switches and mechanical devices that are unable to function reliably for prolonged periods. This type of machine is inherently subject to abuse from forceful striking with golf clubs, so it must be able to withstand repeated forceful blows without damage. Another problem is that ball delivery systems are constructed either to deliver the ball to a flat mat or onto a tee and not both. As a result, both tee shots and fairway shots cannot be practiced. Furthermore, left handed golfers usually cannot conveniently use a machine that is made for right handed players.

SUMMARY OF THE INVENTION

The present invention is directed to a golf ball practice device which is improved in a number of respects compared to the equipment that has been proposed in the past.

In particular, the present invention is characterized by an automatic ball delivery system which operates in a reliable manner to place golf balls on a tee without jamming of the balls, misapplication of the balls to the tee, or other malfunctions. The provision of a carousel type delivery system for the balls is important in this respect, because it is able to assure that the balls are delivered one at a time with the proper timing and reliability. With respect to the delivery of the balls and synchronized operation of the teeing mechanism, the present invention provides a motor that raises and lowers the tee at the proper times in synchronization with the carousel which delivers the balls to the teeing area. The carousel system is able to handle a large number of balls and to reliably deliver them to the tee area one at a time without jamming or other mechanical problems. The motor for the tee operates through a special linkage to lower the tee each time a ball approaches the tee area, and to then raise the tee when the ball is in the proper position to be teed up on the tee.

It is an important feature of the invention that the height of the ball on the tee can be selected as either a high or low position. This feature is easily implemented by a simple height selector switch. Further, both the low tee setting and the high tee setting can be adjusted to accommodate the particular style of different users.

Another important aspect of the invention is the provision of two different tees, one of which is located for use by right handed players and the other of which is located for use by left handed players.

As an alternative to delivering the balls onto a tee, the machine can be easily adjusted to deliver the balls onto a flat surface that simulates fairway conditions. This feature allows fairway shots to be practiced as well as tee shots. The mat which simulates a golf course fairway can be removed and replaced by different mats, one of which may simulate the taller grass found in rough areas of golf courses and the other of which can simulate a sand trap. In this manner, various conditions of play can be practiced simply by interchanging different mats.

The machine of the present invention is characterized by a two-piece construction which enhances its portability. The carousel ball delivery mechanism and the ball striking areas are formed on one piece. The other piece takes the form of a platform that provides a surface on which the player stands while practicing golf shots. The platform has a detachable connection which allows the two pieces to be separated and carried separately to avoid the need to bear the weight of the entire machine when it is moved. Also, it can be transported or stored in a more compact condition when the two pieces are separated. The connection between the two pieces in the machine is arranged to provide the additional advantage of allowing the platform to be adjusted side to side so that the ball can be located more forwardly or more rearwardly in the stance of the player for different types of shots.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views:

FIG. 12 is a rear elevational view of the golf practice machine, with the broken lines showing the lugs which hold the two pieces of the machine together rotated to a locked position in which the two pieces of the machine are locked together;

FIG. 13 is a rear elevational view similar to FIG. 12, but showing the lugs rotated to a release position in which the two parts of the machine are detached;

FIG. 14 is a fragmentary elevational view showing the detail identified by numeral in FIG. 6, with the battery of the machine secured in place by releaseable straps;

FIG. 15 is a fragmentary elevational view similar to FIG. 14, but showing the straps released and the battery removed from the machine;

DETAILED DESCRIPTION OF THE INVENTION

Figure 1:
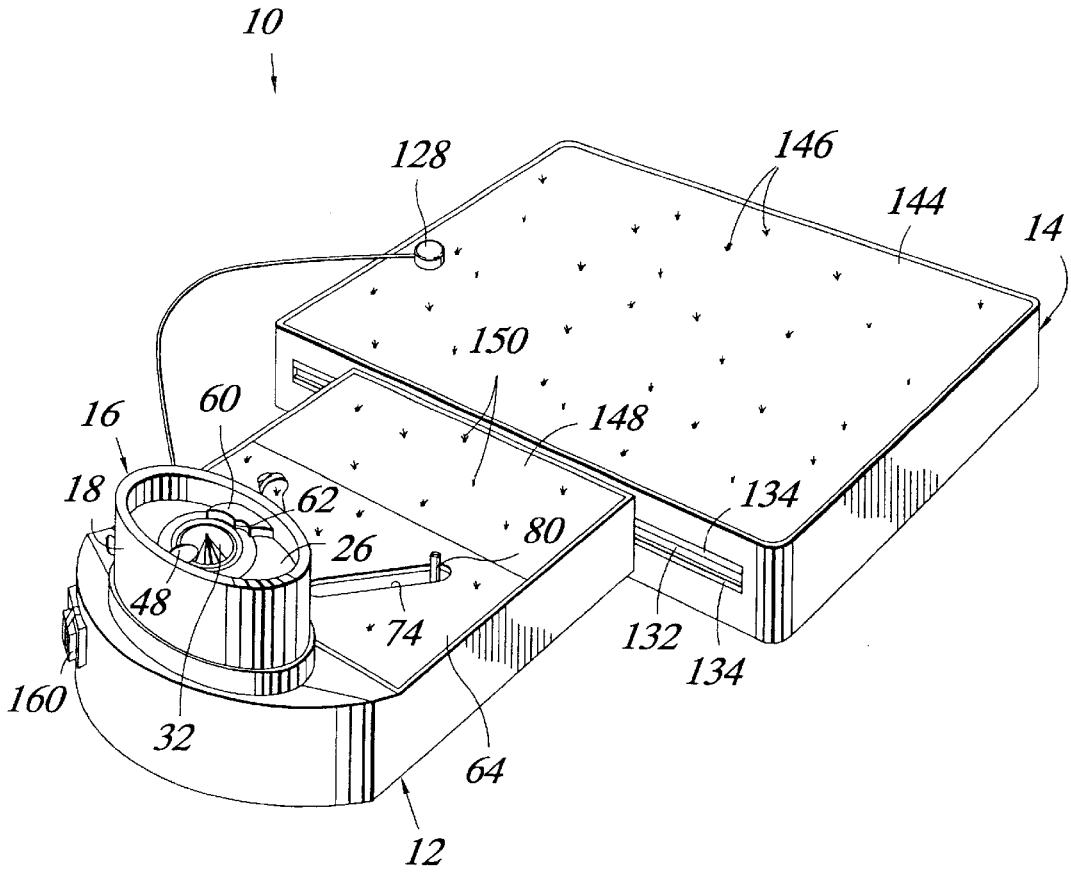
FIG. 1 is a perspective view of a golf practice machine constructed according to a preferred embodiment of the present invention.

Referring now to the drawings in more detail and initially to FIG. 1 in particular, numeral 10 generally designates a machine which is used for practicing golf shots in accordance with the present invention. The machine 10 includes two principal parts, a frame 12 which supports a ball delivery system and a striking area of the machine and a platform 14 on which the golfer stands while using the machine. The frame 12 and platform 14 are connected together when the machine is in use, as will be explained more fully.

Figure 6:
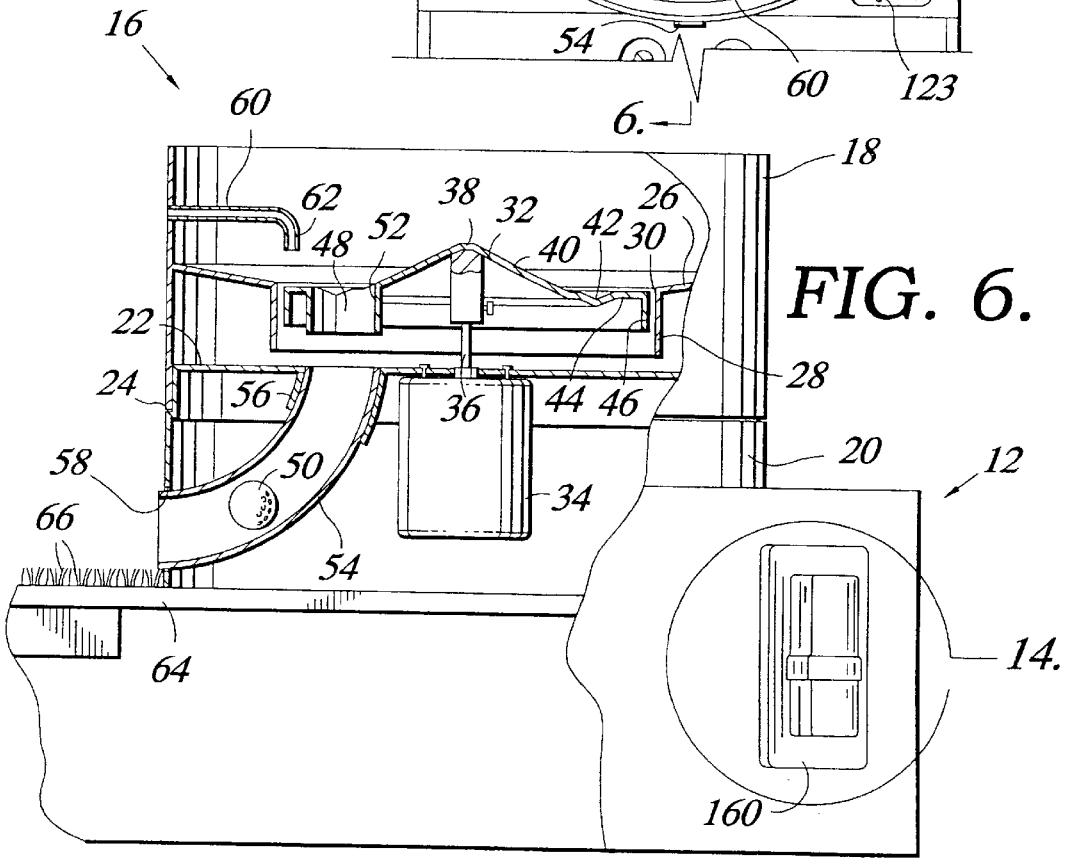
FIG. 6 is a fragmentary sectional view taken generally along line 6—6 of FIG. 5 in the direction of the arrows, with a golf ball shown dropping through the chute which forms part of the ball delivery system.
Figure 7:
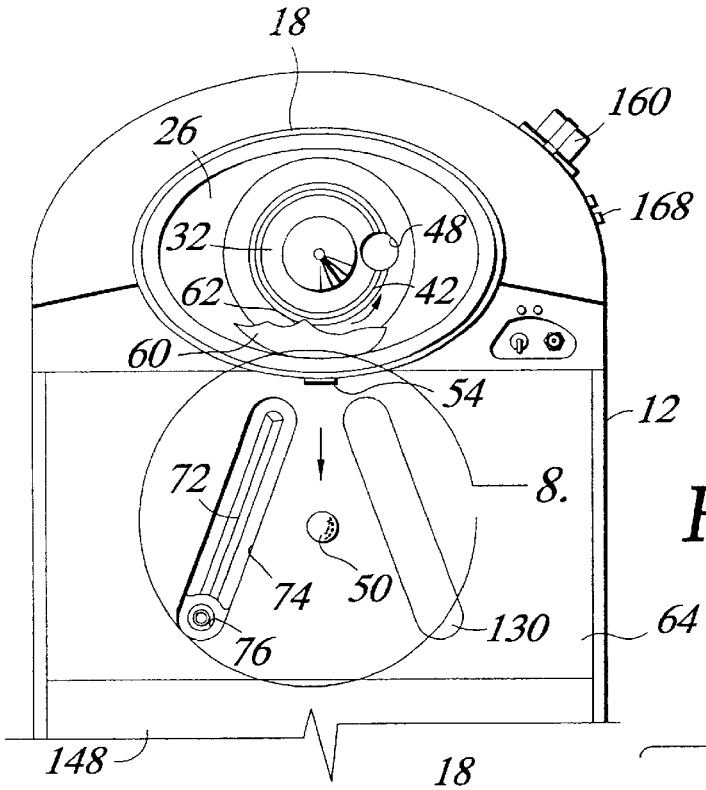
FIG. 7 is a fragmentary top plan view of the carousel system of the machine and showing a golf ball discharged from the delivery chute toward a mat which is included on the machine to simulate fairway conditions of a golf course.

The frame 12 supports a carousel type ball delivery system which is generally identified by numeral 16 and which includes an open topped bin 18 that may have a generally oval shape. With particular reference to FIG. 6, the bin 18 is received on a base 20 which is suitably secured to extend upwardly from the frame 12. The base 20 has a horizontal top panel 22 and a peripheral ledge 24 on which the lower edge of the rim of bin 18 seats. The bin 18 is secured to the base 20 by suitable fasteners (not shown).

The bin 18 has an interior panel 26 which inclines downwardly from the outer wall of the bin and terminates in a down turned flange 28 extending around a circular turntable opening 30. A turntable 32 is received in the opening 30 and is rotated by an electric motor 34 having an output shaft 36 connected with the center of the turntable 32 on its underside. The motor 34 is suitably secured to the plate 22 of base 20.

The turntable 32 has a crowned center 38 and a generally conical surface 40 which inclines downwardly from the crown 38 toward a circular track 42 formed at the lower end of the conical surface 40. The track 42 preferably takes the form of a V-shaped rut in the turntable 32. A generally horizontal surface 44 extends outwardly from the track 42 and connects with a down turned skirt 46 forming the rim of the turntable. The skirt 46 is close to but spaced slightly inwardly from the flange 28 to allow the turntable 32 to rotate freely within the opening 30.

The turntable 32 is provided with a circular opening or pocket 48 which is slightly larger than the diameter of a conventional golfball such as the ball 50 shown in FIG. 6 and other of the drawings. The pocket 48 is located on the track 42 and is surrounded by a collar 52 on the underside of the turntable 32. The bottom end of the collar 52 is spaced above the plate 22 a distance less than the diameter of the ball 50.

The bin 18 may be any suitable size and shape and is preferably large enough to receive a relatively large number of the golf balls 50 at a time. The balls that are loaded into the bin 18 roll down the inclined panel 26 toward the turntable and into the track 42 due to the low position of the track on the turntable. As the turntable rotates, one ball at a time is received in the pocket 48 because of the restricted size of the pocket.

Figure 8:
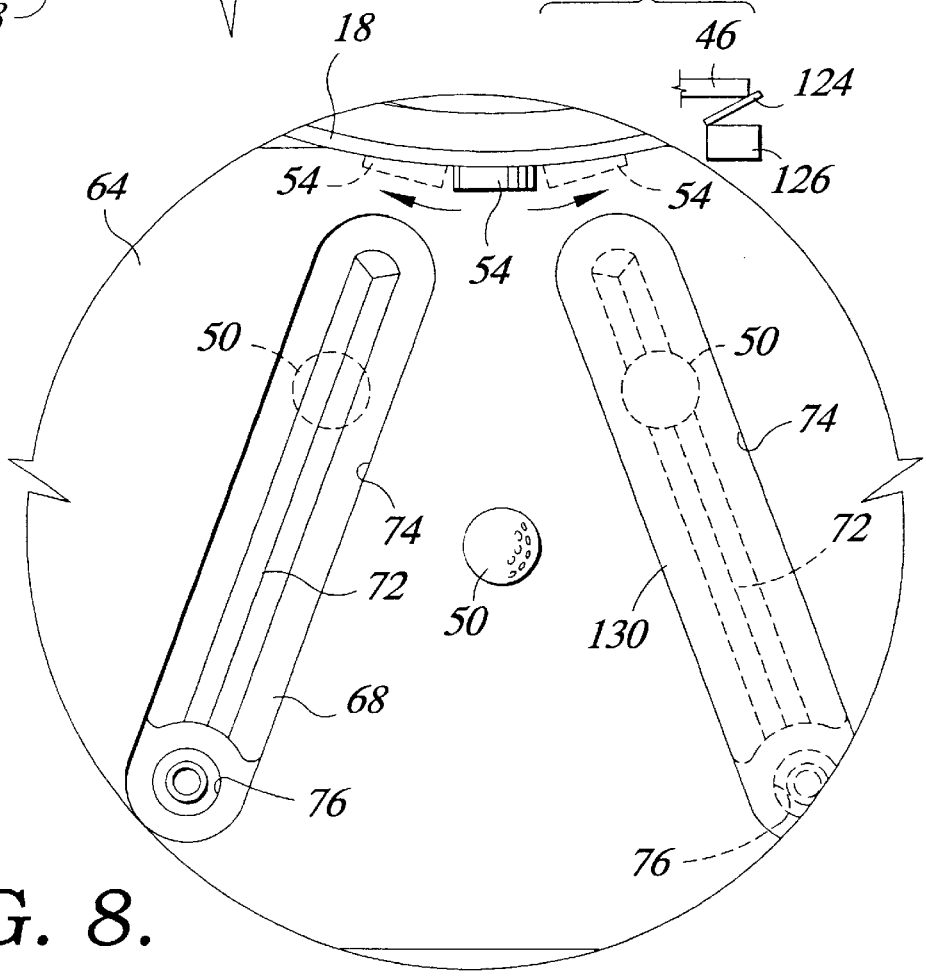
FIG. 8 is a fragmentary plan view on an enlarged scale showing the detail identified by numeral 8 in FIG. 7, with the broken line positions of the chute showing adjustment of the chute when balls are to be teed up by the machine.

The ball dispensing mechanism includes a curved chute 54 having its generally vertical upper end received in a sleeve 56 that projects generally downwardly from the top panel 22 of the base 20. The lower or discharge end of the chute 54 is generally horizontal and extends through an opening 58 which is formed in the rear wall of the base 20. The chute 54 is curved through an angle of approximately 90° between its top and bottom ends. The top end of the chute is able to pivot in the sleeve 56 in order to adjust the direction of the discharge end of the chute. As best shown in FIGS. 12 and 13, the opening 58 is wide enough to accommodate pivoting of the chute 54 to both sides as well as to the centered position shown in FIGS. 12 and 13. Adjustment of the chute in this fashion is shown in FIG. 8, wherein the broken line positions show the chute adjusted as far as possible to both sides and the solid line position shows the chute adjusted to a centered position within the opening 58. The chute 54 is large enough to receive each of the golf balls 50. A choke device or other structure can be inserted in the chute 54 in order to control the speed of balls that discharge from the chute.

Once during each revolution of the turntable 32, the pocket 48 moves to a location at which it registers with the top end of chute 54, as best shown in FIG. 6. In this position of the turntable, a golf ball 50 located in the pocket 48 drops out of the pocket into the chute 54. With continued reference to FIG. 6 in particular, an obstruction which takes the form of a ledge 60 having a downwardly extending finger 62 extends inwardly from the wall of the bin 18 at a location above the chute 54. The finger 62 is located to block golf balls 50 from entering the chute 54, except for the single ball 50 which is located in the pocket 48. The ball 50 in pocket 48 rides around with the turntable in pocket 48 on the surface of the base panel 22 and is able to clear beneath the edge of the finger 62 due to its relatively low position on the turntable 32 in the pocket. Other balls, including balls in the track 42 are unable to clear the lower end of the finger and enter the chute. In this manner, the carousel system dispenses only a single ball 50 into the chute 54 for each revolution of the turntable 32. Once the turntable 32 has rotated past a position aligned above chute 54, another ball 50 can enter the pocket 48.

The discharge end of the chute 54 is located immediately above a horizontal mat 64 which is provided with artificial grass 66 that simulates the grass found on a typical golf fairway.

Figure 9:
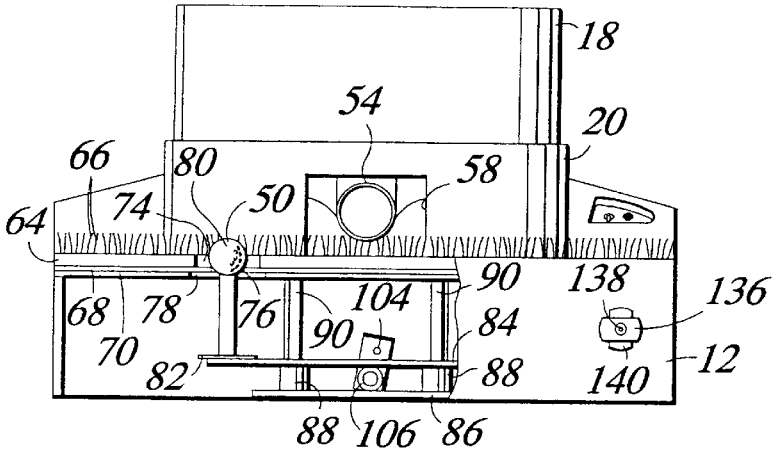
FIG. 9 is a fragmentary sectional view taken generally along line 9—9 of FIG. 2 in the direction of the arrows and showing a tee of the machine in its lowered position to receive a golf ball on the tee.
Figure 10:
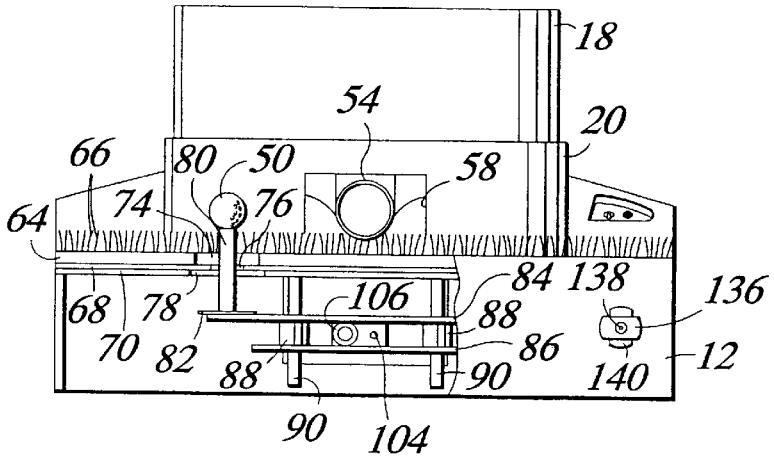
FIG. 10 is a fragmentary sectional view similar to FIG. 9, but showing the tee raised to a low tee height at which the golf ball is teed to a relatively low elevation.
Figure 11:
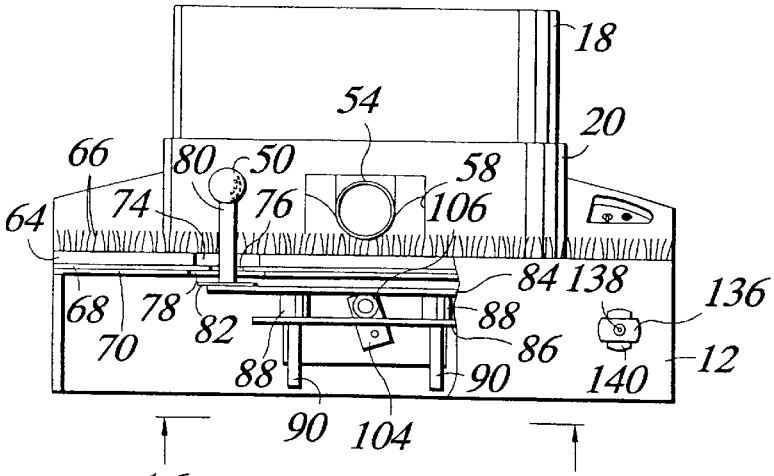
FIG. 11 is a fragmentary sectional view similar to FIGS. 9 and 10, but showing the tee raised to a high tee height at which the golf ball is teed to a relatively high elevation.

As best shown in FIGS. 9–11, the mat 64 is received on top of a thin pad 68 which may be constructed of rubber or a similar material. The pad 68 in turn is received on top of a rigid horizontal plate 70 which is suitably secured to the frame 12. The plate 70 may be constructed of metal.

As best shown in FIG. 8, the pad 68 is provided on its upper surface with a pair of inclined troughs 72 which immediately underlie cutouts 74 formed through the mat 64. Each cutout 74 is considerably wider than the diameter of one of the golf balls 50. Each trough 72 has the size to receive one of the balls 50 in it and to retain the ball in the trough as the ball rolls along the length of the trough. Each trough 72 is located with one end close to the discharge end of the chute 54.

Each trough 72 inclines downwardly from the end close to the chute to an opposite end which is provided with a circular opening 76. Each opening 76 is smaller than the diameter of the golf ball 50 and provides a seat for each ball delivered to the trough 72. The rigid plate 70 is provided with a relatively large opening 78 underlying each of the trough openings 76.

There are two of the troughs 72 provided so that one may be used by a right handed golfer and the other by a left handed golfer. The troughs 72 are oriented to diverge as they extend away from chute 54. The trough 72 located to the left as viewed in FIG. 8 is normally used by a right handed player, while the other trough is normally used by a left handed player. Both of the troughs are angled outwardly toward the side area of the machine as they extend downwardly. The trough on the left as viewed in FIG. 8 is located such that it receives balls that are discharged from the chute 54 when the chute is adjusted to the broken line position shown as the leftmost position of the chute in FIG. 8. Conversely, the other trough 72 is located to receive golfballs discharging from chute 54 when the chute is adjusted to the rightmost position shown in broken lines in FIG. 8. By adjusting the chute 54 to one side or the other, the trough 72 which is to receive balls for the user is selected.

In accordance with the present invention, each time a golf ball 50 is delivered to the lower end of one of the troughs 72 into the opening 76, a tee 80 is raised in order to automatically tee the ball up on the tee 80. For the sake of explanation, it is assumed that the trough located on the left as viewed in FIG. 8 has been selected by adjusting chute 54 to direct balls to it. With particular reference to FIGS. 9–11, the tee 80 may take the form of a hollow vertical tube having a flat base 82. The base may be screwed or otherwise detachably connected with a horizontal bracket 84 located beneath the plate 70. Another horizontal bracket 86 is spaced beneath bracket 84 by a pair of spacer sleeves or bushings 88 suitably secured to the brackets 84 and 86. The spacer sleeves 88 fit around a pair of vertical guide pins 90 connected at their upper ends to the plate 70. This arrangement restricts the brackets 84 and 86 and the tee 80 to vertical movement along the pins. The tee can be raised and lowered between the fully lowered position shown in FIG. 9 and the fully raised position shown in FIG. 11. The tee 80 is located in registration with the opening 76 so that it moves upwardly and downwardly therein. In the fully lowered position of FIG. 9, the upper end of the tee 80 is located immediately beneath the opening 76 and thus immediately beneath a ball 50 which is received and seated in the opening 76.

Figure 16:
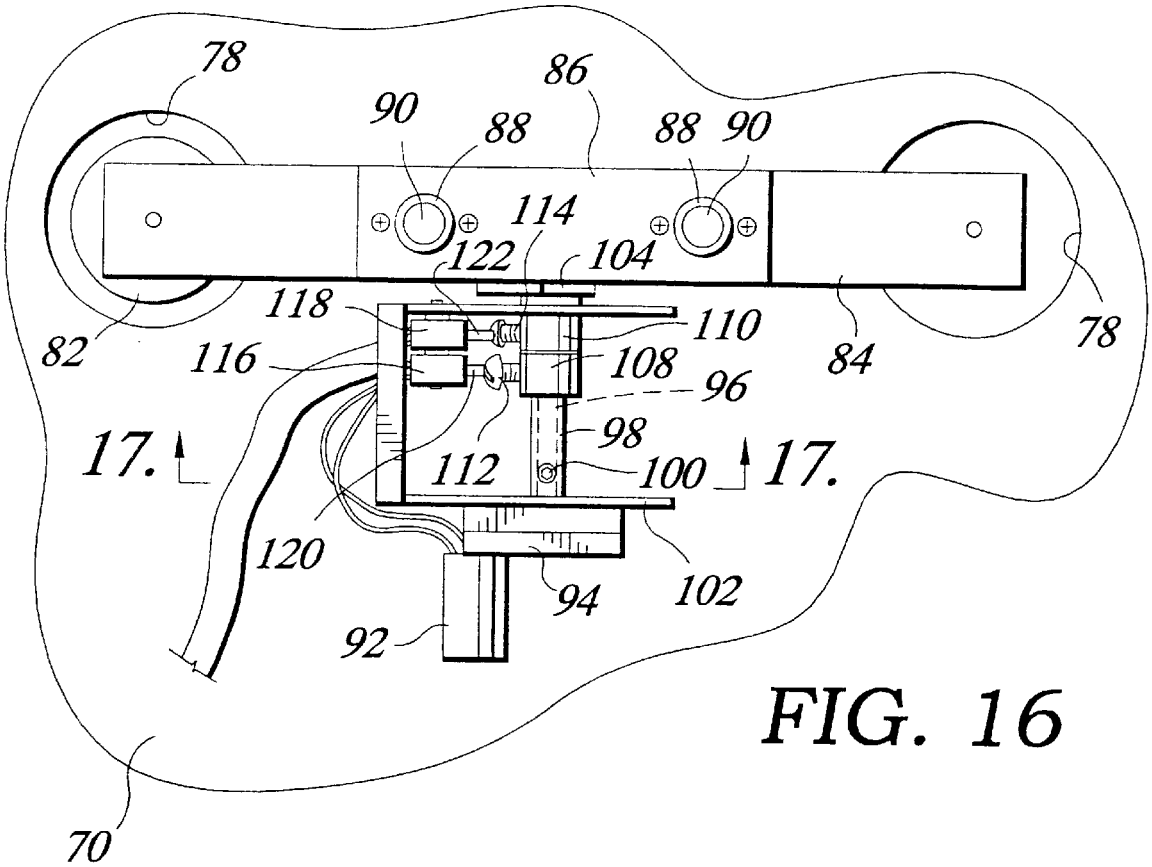
FIG. 16 is a fragmentary bottom plan view on an enlarged scale taken generally along line 16—16 of FIG. 11 in the direction of the arrows.

With reference to FIG. 16 in particular, the tee 80 is raised and lowered by an electric motor 92 driving a gear box 94. The gear box 94 has an output shaft 96 which extends through and is secured to a sleeve 98 by a set screw 100. The gear box 94 and the shaft and sleeve 96 and 98 are mounted on a bracket 102 that is suitably secured to the underside of plate 70.

A crank arm 104 is secured to the end of the shaft 96. The end of the arm 104 opposite the end that connects with the shaft 96 is provided with a roller 106 (see FIGS. 9–11) that fits closely between the two brackets 84 and 86. When the motor 92 is operated, the crank arm 104 rotates from the position shown in FIG. 9 to the position shown in FIG. 10, thus raising the roller 106 along an arcuate path and lifting the brackets 84 and 86 as well as the tee 80 straight upwardly. Continued rotation of the arm 104 from the position shown in FIG. 10 raises the brackets and tee 80 to the fully raised position shown in FIG. 11.

Figure 17:
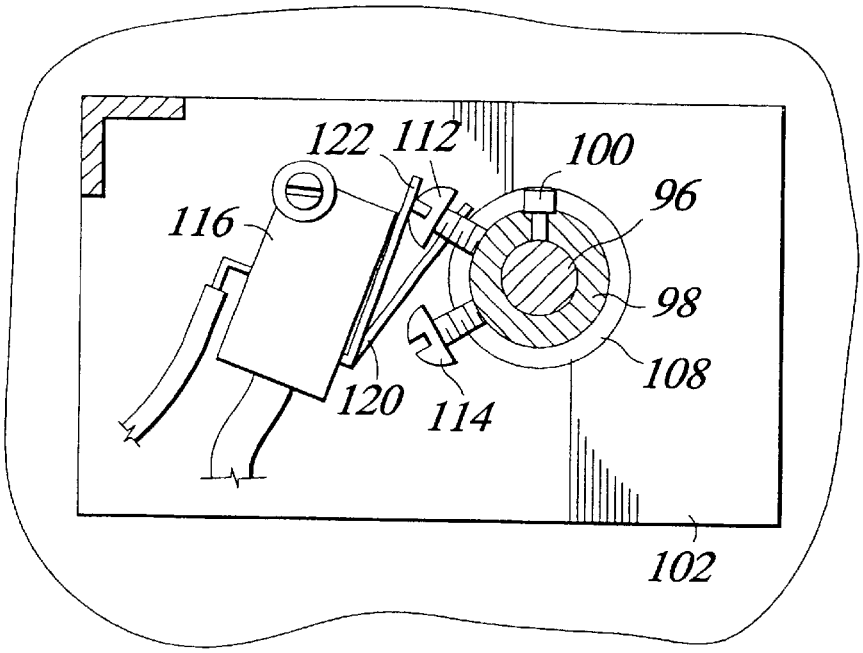
FIG. 17 is a fragmentary sectional view on an enlarged scale taken generally along line 17—17 of FIG. 16 in the direction of the arrows.

With reference again to FIGS. 16 and 17 in particular, the sleeve 98 is provided with a pair of side by side collars 108 and 110. The collars 108 and 110 are secured to the sleeve 98 by respective screws 112 and 114 which are offset as to their rotational positions on the sleeve 98. The screws 112 and 114 project a considerable distance outwardly from the collars 110 and 112. The motor 92 is turned off after each revolution of shaft 96 by a pair of switches 116 and 118 having respective switch actuating arms 120 and 122. The switches 116 and 118 are suitably secured to the bracket 102. The screws 112 and 114 are located to engage the respective actuator arms 120 and 122 in order to depress each actuator arm as shown for arm 120 in FIG. 17. When each actuator arm is depressed, the corresponding switch is in an open condition. The staggered or offset rotational positions of the screws 112 and 114 is selected so that screw 114 depresses actuator arm 122 when the tee 80 is in the position shown in FIG. 10 which is a low tee height for the ball 50. The other arm 120 is depressed by screw 112 when the tee 80 is in the high tee setting shown in FIG. 11.

Figure 4:
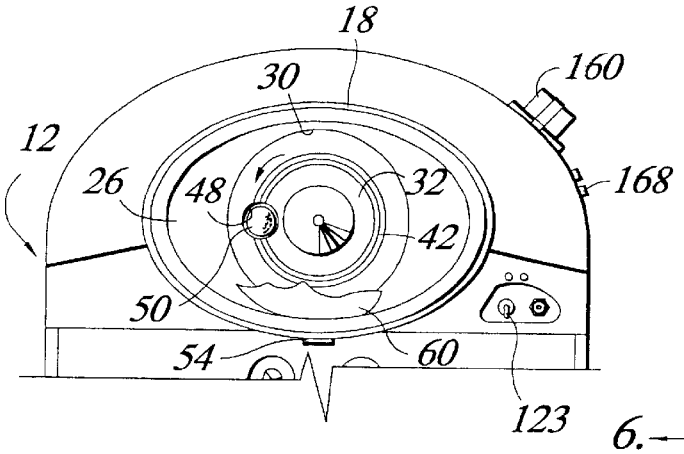
FIG. 4 is a fragmentary top plan view similar to FIG. 3, but showing the golf ball received in the ball receiving pocket of the track.
Figure 5:
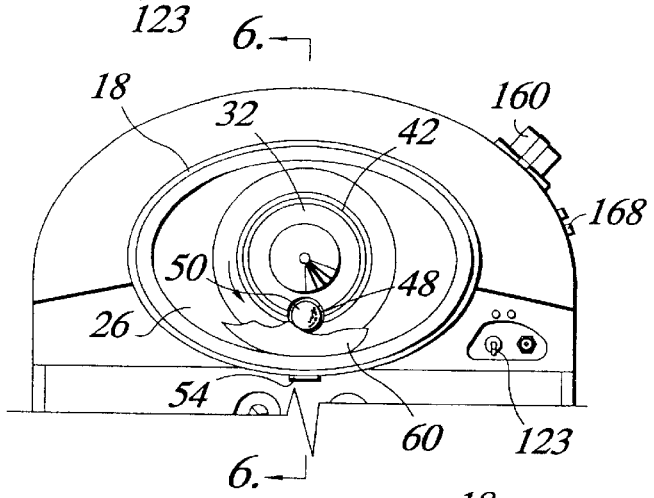
FIG. 5 is a fragmentary top plan view similar to FIGS. 3 and 4, but showing the ball receiving pocket rotated around to deliver the ball to the discharge location of the turntable.

The motor 92 for the tee 80 is controlled by whichever of the switches 116 or 118 is selected by a selector switch 123 (see FIGS. 4 and 5). The switch 123 may have an off setting at which motor 92 is maintained in a deenergized state. Switch 123 has a low setting which corresponds to the low tee height shown in FIG. 10. In this setting of the selector switch 123, switch 118 is selected to control motor 92 to the exclusion of the other switch 116. The final setting of switch 123 is a high setting which corresponds to the high tee elevation shown in FIG. 11. In this setting of switch 123, switch 116 is selected to control the motor 92.

The screws 112 and 114 can be adjusted rotationally on sleeve 98 to provide an adjustment of the height of the tee 80 at its low teed position (FIG. 10) and its high teed position (FIG. 11). By adjusting screw 114 and collar 110 in a clockwise position as viewed in FIG. 17, the switch arm 122 is depressed when the tee 80 has been raised to a lower position than shown in FIG. 10. This allows adjustment of the low tee height downwardly from the position shown in FIG. 10. Conversely, by adjusting screw 114 in a counterclockwise direction as viewed in FIG. 17, the actuator arm 120 is depressed at a later position which allows the tee 80 to be raised slightly from the position shown in FIG. 10 before the motor 92 is deenergized. In a similar manner, the other screw 112 can be adjusted rotationally to provide an adjustment of the high tee elevation both upwardly and downwardly from the position shown in FIG. 11.

The motor 34 which rotates the turntable 32 is deactivated by a switch system which is best shown in FIG. 8. An edge of the skirt 46 on the rim of the turntable 32 acts as a trip for depressing a switch arm 124 of a switch 126 mounted on plate 22 adjacent to the turntable opening 30. When the switch arm 124 is depressed by the skirt 46, switch 126 deenergizes the motor 34. Thus, each time the motor 34 has driven turntable 32 through a full revolution, the motor 34 is deenergized to stop rotation of the turntable.

Figure 2:
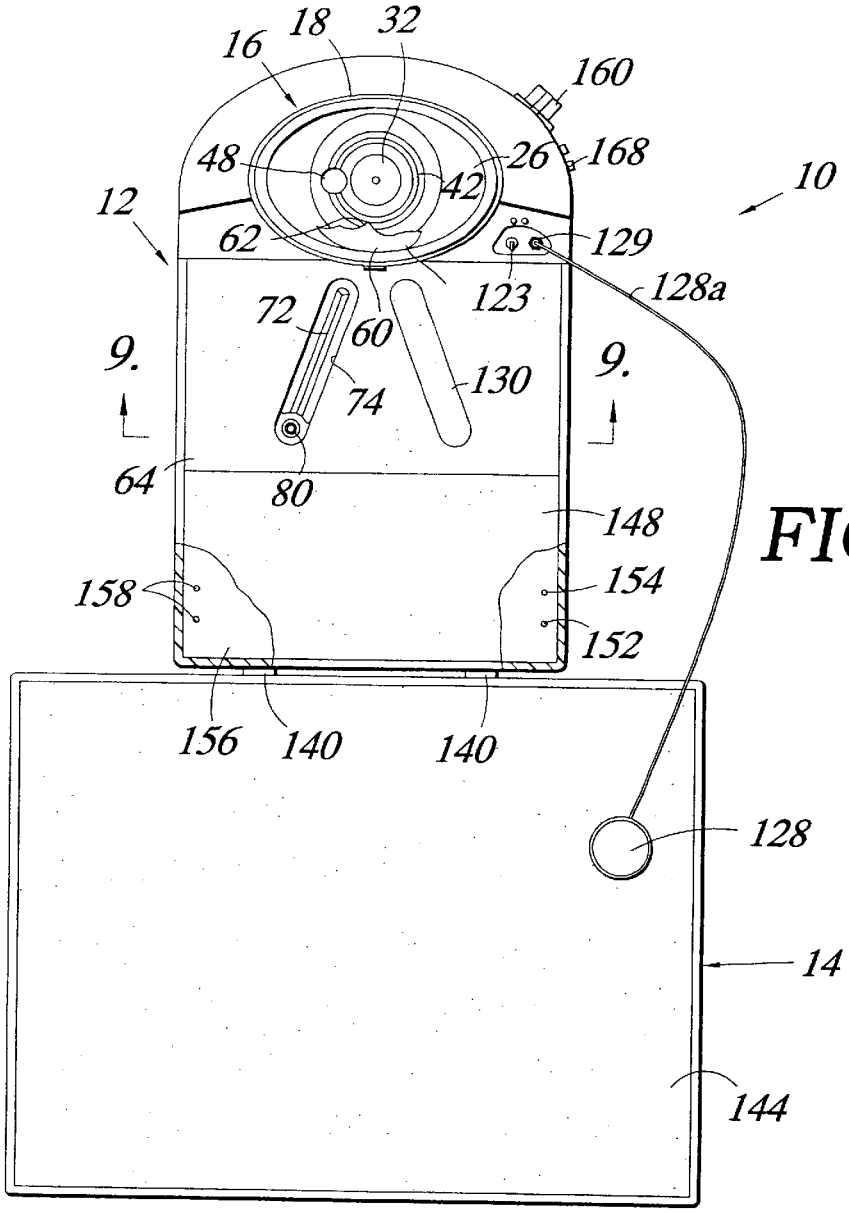
FIG. 2 is a top plan view of the machine shown in FIG. 1, with the break lines diagrammatically showing different types of surfaces that can be provided on interchangeable mats included on the machine.

As shown in FIGS. 1 and 2, a pedal switch 128 which may be placed on the platform 14 can be activated to energize both the turntable motor 34 and the tee motor 92. The pedal switch 128 has an elongated cord 128*a* that may be plugged into a jack 129 (FIG. 2) located on the frame 10 near the selector switch 123. The motors 34 and 92 are synchronized (with motor 92 being geared down through the gear box 94) such that the tee 80 is lowered to the fully lowered position shown in FIG. 9 by the time motor 34 has rotated the turntable around to drop one of the balls 50 through the chute 54 and along the trough 72 into a seated positioned in opening 76. Motor 92 continues to operate to raise the tee to either the low teed up elevation shown in FIG. 10 or the high teed up elevation shown in FIG. 11, depending upon the setting of the selector switch 123. One teeing cycle of the machine is initiated each time the pedal switch 128 is depressed.

It is to be understood that the teeing mechanism operates in the same fashion when the chute 54 is swung to the right position shown in broken lines in FIG. 8 and the trough 72 on the right side is used, as by a left handed player. Preferably, the cutout 74 associated with the trough 72 that is not selected for use is provided with a removable plug 130 which has a size and shape to fit closely in either of the openings 74 and which has artificial grass on its upper surface similar to the grass 66 on mat 64.

As previously indicated, the frame 12 and platform 14 may be detachably connected.

As shown in FIG. 1 and in FIGS. 12 and 13, the forward face of the platform 14 is provided with a horizontal channel 132 having a down turned flange 134 along its upper edge and an upturned flange 134 along its lower edge. The backside of the frame 12 is provided with a pair of spaced apart lugs 136 mounted to turn on horizontal pins 138. Connected with each lug is a lug base 140 that may be gripped with a suitable wrench 142 in order to turn each of the lugs 136.

In order to connect the frame 12 and platform 14, the lugs 136 may be turned to the horizontal positions shown in FIG. 13. In this orientation of each lug 136, the lug can be inserted into the channel 132 behind the flanges 134. The wrench 142 may then be applied to the lug bases 140 and turned through 90° to rotate the lugs 136 to the vertical positions shown in FIG. 12. In the vertical position, each lug 136 extends behind the two flanges 134 in order to secure the frame 12 and platform 14 together.

It is an important feature of the invention that the fit of the lugs 136 in the channel 132 allows the frame 12 and platform 14 to be adjusted from side to side relative to one another. If the platform 14 is slid to one side, the lugs are able to slide behind the flanges 134 while maintaining the frame and platform connected together. This allows the user standing on the platform 14 to adjust the position of the tee 80 forwardly or rearwardly in his or her stance for different types of shots. Preferably, the upper surface of the platform 14 is provided with a mat 144 having artificial grass 146 (see FIG. 1) similar to the grass 66 on mat 64. The mat 144 is preferably at the same elevation as the mat 64.

The platform 14 can be detached by using the wrench 142 to turn the lug bases 140 until the lugs are oriented horizontally as shown in FIG. 13. Then, the lugs are able to slip out of the channel 132 to release the platform.

With reference to FIG. 1 in particular, the area between the mat 64 and platform 14 is provided with a mat 148 that may have simulated grass 150 similar or identical to the grass 66 and 146. When the chute 54 is adjusted to the center position shown in solid lines in FIG. 8, the golfballs 50 discharged from the chute are directed between the two cutouts 74 and roll over mat 64 onto mat 148. Each ball rolls to the same position at or near the center of mat 148. The user can strike each ball that is delivered onto mat 148 with a golf club, thus practicing hitting balls from a fairway surface. The ball is delivered repeatedly to an ideal position to be struck.

The mat 148 can be removed and replaced with one or more additional mats which simulate other types of surfaces that may be encountered in the play of golf. For example, as shown in FIG. 2, a different mat 152 may be installed in place of mat 148. The mat 152 may be provided with artificial tall grass 154 that simulate the conditions encountered in rough areas of golf courses. Alternatively, yet a different mat 156 may be installed in place of the other mats 148 and 152. Mat 156 may be provided with a surface 158 that simulates the conditions in a sand trap of the type encountered during the play of golf. Each of the mats 148, 152 and 156 may be detachably secured in place on the frame 14 by suitable fasteners or otherwise.

Figure 3:
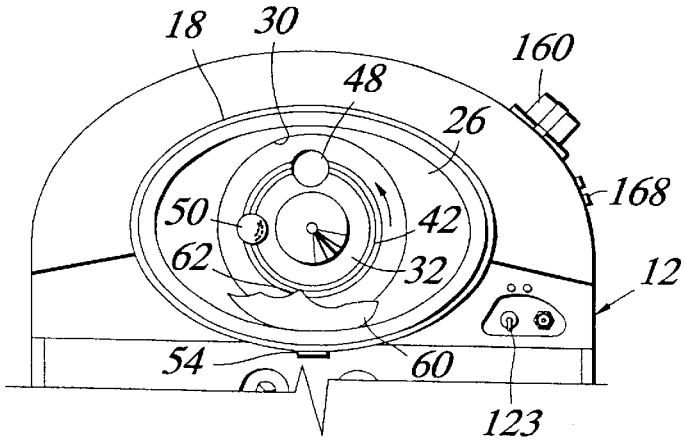
FIG. 3 is a fragmentary top plan view on an enlarged scale of the carousel delivery system of the machine, with a single golf ball shown in the track portion of the turntable and the turntable rotating such that a ball receiving pocket in the track is shown approaching the golf ball.

A battery 160 (see FIGS. 14 and 15 in particular) is preferably used to power the machine 10 to enhance its portability. The battery 160 may be installed in a receptacle 162 formed in the frame 14 such that the battery terminals mate with electrical contacts for the control circuitry for the motors when the battery is in place in its receptacle. Releaseable straps 164 having mating hook and loop type fasteners 166 on their overlapping surfaces may be used to tightly secure the battery 160 in the receptacle 162 while allowing the battery to be removed as desired. In order to protect the battery for the machine, it is preferred that the battery be removed from the receptacle 162 for charging. Thus, the convenience of the receptacle and straps 164 readily accommodates removal and reinstallation of the battery 160. At the same time, the straps 164 securely hold the battery in the receptacle even when the machine is subjected to jarring forces. AC power can be applied through a jack 168 (FIG. 3) to operate the motors of the machine from AC power.

To use the machine 10, a desired number of golf balls 50 are loaded into the bin 18, and the user assumes his or her desired position on the platform surface 144. If the golfer is right handed and desires to practice tee shots, the chute 54 is turned to the left broken line position shown in FIG. 8, wherein the discharge end of the chute is aligned with the cutout 74 and the trough 72. The plug 130 is preferably applied to the other cutout 74. The user initiates a cycle of the machine by depressing the pedal switch 128, thus activating both the turntable motor 34 and the tee motor 92. As motor 34 rotates the turntable 32, one of the balls 50 in the bin 18 is received in the pocket 48 and is carried around in the pocket on the panel 22 as the turntable continues to rotate. When the pocket 48 has been rotated to a position in registration above the chute 54, the ball 50 drops out of the pocket 48 and passes through the chute 54 into the upper end of trough 72. Once the ball 50 has been discharged into the trough 72, it travels under the influence of gravity to the lower end of the trough until it has seated in the opening 76.

When motor 92 is energized by depression of the pedal switch, it operates through the gear box 94 to rotate the crank arm 104 at a speed that results in the tee 80 being at its lowermost position, shown in FIG. 9, at the time the ball 50 reaches its seated position in opening 76. Continued operation of the motor 92 causes the brackets 84 and 86 to raise, thus raising the tee 80. If the selector switch 123 is set in the low tee setting, motor 92 is deenergized when the tee 80 has been raised to the low tee elevation shown in FIG. 10. In this setting of the selector switch, switch 118 controls motor 92, and its actuator arm 122 is depressed by screw 114 when tee 80 has been raised to the low tee elevation shown in FIG. 10. Depression of the switch arm 122 deenergizes the motor 92.

Alternatively, if the selector switch 123 is in the high tee setting, the crank arm 104 continues to rotate until the other switch actuator arm 120 is depressed by the other screw 112. Then, because switch 116 has been selected by the setting of the selector switch 123, the depression of switch arm 120 deenergizes the motor through switch 116. Then, the ball 50 is in the high tee elevation shown in FIG. 11.

In either case, the ball 50 is automatically teed up to the height selected by the user, and the user can then strike the ball on the tee. Additional cycles, each resulting in another ball 50 being automatically teed to the desired height on tee 80, can be initiated by subsequent depressions of the pedal switch 128. It is noted that the user can take as long as desired between successive cycles of the machine, so that he or she can hit successive balls as quickly or as leisurely as desired. Further, balls can be teed higher or lower simply by changing the setting of the selector switch 123.

If the user is left handed or for any reason wants to use the trough 72 located to the right as viewed in FIG. 8, he or she can mount the tee 80 in a position to underlie the opening 76 of the right trough, move the plug 130 from the right cutout 74 to the left cutout 74, and swing the discharge end of chute 54 to the rightmost broken line position shown in FIG. 8. The machine then operates in the same manner described in connection with the left trough.

The turntable motor 34 is automatically deenergized after a ball has been discharged into the chute 54 by depression of switch arm 124 by the turntable skirt 46. It is preferred that the turntable motor be deenergized a short time prior to the pocket 48 coming into registration with the chute 54 so that the turntable can discharge a ball into the chute 54 and then coast a short distance to carry the pocket 48 out of registration with the chute. In cooperation with the blocking action provided by the finger 62, this prevents more than one ball from being delivered to chute 54 at a time. It also prevents the balls from becoming jammed in the area of the pocket 48 and chute 54 or being otherwise mishandled by the machine.

If a player desires to hit fairway shots rather than tee shots, he or she can simply pivot the chute 54 until its discharge end is centered between the two troughs 72 in the position shown in solid lines in FIG. 8. Then, balls that are discharged from the chute 54 roll along the mat 64 between the two troughs and travel to a stop near the center of mat 148. The user can move if necessary to properly address and strike a ball delivered to the center of mat 148.

Shots from a rough area of a golf course can be practiced by replacing the fairway mat 148 with the rough mat 152. Similarly, sand shots can be practiced by installing mat 156 rather than either of the other mats 148 or 152.

The platform 14 can be detached from the frame 12 to facilitate carrying of the device and transporting or storing it. To disconnect platform 14 from frame 12, the wrench 142 may be applied to each of the lug bases 140 and rotated 90° to turn each lug 136 from the position shown in FIG. 12 to the position shown in FIG. 13. The lugs 136 can then be removed through the channel 142, and the platform 14 can be carried, stored or transported separately from the frame 12 and the components mounted on the frame. The machine 10 can be constructed with the frame 12 and platform 14 each weighing approximately 35 pounds, and it is obvious that they can be manually carried much more easily when disconnected than in a case where the entire machine must be carried as a unit. Portability is an important feature of the invention, as it is contemplated that the machine will be used in backyards and garages or other places where it must be put away on a regular basis.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. Portable apparatus for practicing striking of golf balls, comprising:

a frame presenting a ball striking area from which golf balls may be struck;

a ball delivery system for delivering golf balls to said ball striking area one at a time; and a platform providing a surface on which a user may stand to strike balls delivered to said striking area, said platform having a detachable connection with said frame to allow the frame and platform to be transported separately;

said detachable connection comprising a substantially horizontal channel on one of said frame and said platform having upper and lower edges and a plurality of rotatable lugs on the other of said frame and platform, said lugs fitting through and into said channel in one rotative position thereof and locking behind said edges of the channel when turned from said one rotative position to allow continuous sideward adjustment of said platform relative to said frame.

* * * * *